US006491302B1

(12) United States Patent
Boylan et al.

(10) Patent No.: US 6,491,302 B1
(45) Date of Patent: Dec. 10, 2002

(54) PAI GOW POKER WITH TIEBREAKER CARDS

(75) Inventors: Eugene B. Boylan, Reno, NV (US); Robert F. Koerner, Gardnerville, NV (US); Russell Hebert, Carson City, NV (US); Scott McBride, Marie (CA)

(73) Assignee: Bet Technology, Inc., Gardnerville, NV (US)

( * ) Notice: Subject to any disclaimer, the term of this patent is extended or adjusted under 35 U.S.C. 154(b) by 0 days.

(21) Appl. No.: 09/900,193

(22) Filed: Jul. 9, 2001

(51) Int. Cl.[7] ..... A63F 1/00
(52) U.S. Cl. ..... 273/292; 273/274; 273/236
(58) Field of Search ..... 273/292, 274, 273/236

(56) References Cited

U.S. PATENT DOCUMENTS 4,861,041 A * 8/1989 Jones et al. ..... 273/292
5,042,818 A * 8/1991 Weingardt ..... 273/274
5,098,107 A * 3/1992 Boylan et al. ..... 273/274
5,224,706 A * 7/1993 Bridgeman et al. ..... 273/292
5,322,295 A * 6/1994 Cabot et al. ..... 273/274
5,377,993 A * 1/1995 Josephs ..... 273/292
5,560,613 A * 10/1996 Nguyen ..... 273/274
5,584,486 A * 12/1996 Franklin ..... 273/274
5,660,393 A * 8/1997 Dreger ..... 273/274
5,762,340 A * 6/1998 Feola ..... 273/274
5,799,945 A * 9/1998 Boylan et al. ..... 273/292
5,863,041 A * 1/1999 Boylan et al. ..... 273/292
5,868,619 A * 2/1999 Wood et al. ..... 273/292
5,928,081 A * 7/1999 Bochichio et al. ..... 273/292
6,155,568 A * 12/2000 Franklin ..... 273/292
6,299,170 B1 * 10/2001 Yoseloff ..... 273/274
6,334,613 B1 * 1/2002 Yoseloff ..... 273/274
6,371,484 B1 * 4/2002 Yuan ..... 273/274
6,386,973 B1 * 5/2002 Yoseloff ..... 273/274

* cited by examiner

*Primary Examiner*—Benjamin H. Layno
*Assistant Examiner*—Dolores Collins
(74) *Attorney, Agent, or Firm*—Larson & Taylor PLC

(57) ABSTRACT

A method of playing a pai gow poker game in which, in addition to the usual seven cards dealt to each player and the dealer, a single player tiebreaker card is dealt for all players and a single dealer tiebreaker card is dealt to the dealer. The ante bet of each player is then paid off for winning and losing hands in the usual manner of a pai gow game. However, with push hands (where only one of the two-card hand and five-card hand of the player has a higher poker rank than the respective two-card hand and five-card hand of the dealer), the winner is determined by the higher value of the player and dealer tiebreaker cards so that no push bets occur.

3 Claims, 1 Drawing Sheet

PAI GOW POKER WITH TIEBREAKER CARDS

FIELD OF THE INVENTION

The present invention relates generally to a method of playing the game of pai gow poker, and more particularly to a method of playing a game of pai gow poker in which ties or a push bet between a respective player and a dealer do not occur.

BACKGROUND OF THE INVENTION

Disclosed in U.S. Pat. No. 5,584,486 (Franklin) is a pai gow poker game with an additional jackpot wager. As disclosed therein, the usual game of pai gow poker in a casino setting is played by a dealer dealing each player (preferably six) and the dealer seven cards. Each player then arranges the seven cards into a two-card (Low) hand and a five card (High) hand, as does the dealer thereafter. Each player wagers an ante bet against the dealer. This ante bet is: won if both the respective Low hand and the High hand have a poker rank greater than the respective poker ranks of the Low hand and High hand of the dealer; lost if both the respective Low hand and the High hand have a poker rank less than the respective poker ranks of the Low hand and High hand of the dealer; and pushed if only one of the respective Low hand and the High hand has a poker rank greater than the respective poker ranks of the Low hand and High hand of the dealer. In this game, ties go to the dealer, and a joker is used in the play which can be used as an ace or to complete a straight or flush.

According to the improved method of play of pai gow in U.S. Pat. No. 5,584,486, an additional jackpot wager is optionally made by each player. The player wins this jackpot wager at odds when the Low hand and High hand together have a predetermined value (such as a pair and straight, or higher High hand). The odds increase in view of the rarity of the possible two hands, up to, for example, 50,000/1 for five aces and a pair.

Another popular modification of the pai gow poker game has been played at "Harvey's Resort and Casino" in Tahoe, Nev. In this modified game, a bonus bet is made (in addition to the ante bet in the usual game for the five-card hand and two-card hand ranks to be compared with those of the dealer). This bonus bet is won at odds if the player has any five cards (or best poker hand) which together rank above a straight (with the odds increasing for increasingly ranked hands). In addition, if a player makes a bonus bet above $5, that player can additionally win a predetermined payoff if any other player has any five cards which together form a poker rank above four of a kind (with the payoff increasing for increasingly ranked hands).

While such pai gow games are entertaining and useful in the gaming industry to increase interest and betting, the presence of push bets wastes time and effort of the casino.

SUMMARY OF THE INVENTION

In accordance with the present invention, a method of playing a pai gow poker game with wagers between a group of respective players and a dealer whose outcome is determined by randomly generated playing cards having various ranks and suits is provided. In this method, an ante bet is wagered by each respective player against the dealer. Seven cards are then dealt to each player and the dealer, and a single player tiebreaker card is dealt for all players and a single dealer tiebreaker card is dealt to the dealer. The seven cards dealt to each player are then arranged by that player into a two-card hand and a five-card hand, as are the seven cards dealt to the dealer by the dealer. The ante bet of each player is then paid off to: (a) the respective player if both the two-card hand and the five-card hand of the player have a higher poker rank than the respective two-card hand and five-card hand of the dealer, (b) the dealer if both the two-card hand and the five-card hand of the player have a lower poker rank than the respective two-card hand and five-card hand of the dealer, (c) the respective player if only one of the two-card hand and five-card hand of the player has a higher poker rank than the respective two-card hand and five-card hand of the dealer, and if the single player tiebreaker card has a higher value than the single dealer tiebreaker card, or (d) the dealer if only one of the two-card hand and five-card hand of the player has a higher poker rank than the respective two-card hand and five-card hand of the dealer, and if the single player tiebreaker card has a lower value than or value equal to the single dealer tiebreaker card.

In a preferred embodiment, the playing cards are a standard deck, and the paying off step includes the step of valuing a value of each single tiebreaker card by rank from higher to lower of ace to 2. In addition, a joker playing card is included as a playing card in the standard deck, and the joker is usable as an ace or as a fill-in card for straights and flushes in the two-card hands and five-card hands, and is considered as an ace for the single tiebreaker card.

It is an object of the present invention to provide a pai gow poker game which avoids ties so that the house draw is increased and the game moves faster.

Other features and advantages of the present invention are stated in or apparent from detailed descriptions of presently preferred embodiments of the invention found hereinbelow.

DESCRIPTION OF THE PREFERRED EMBODIMENTS

Figure 1:
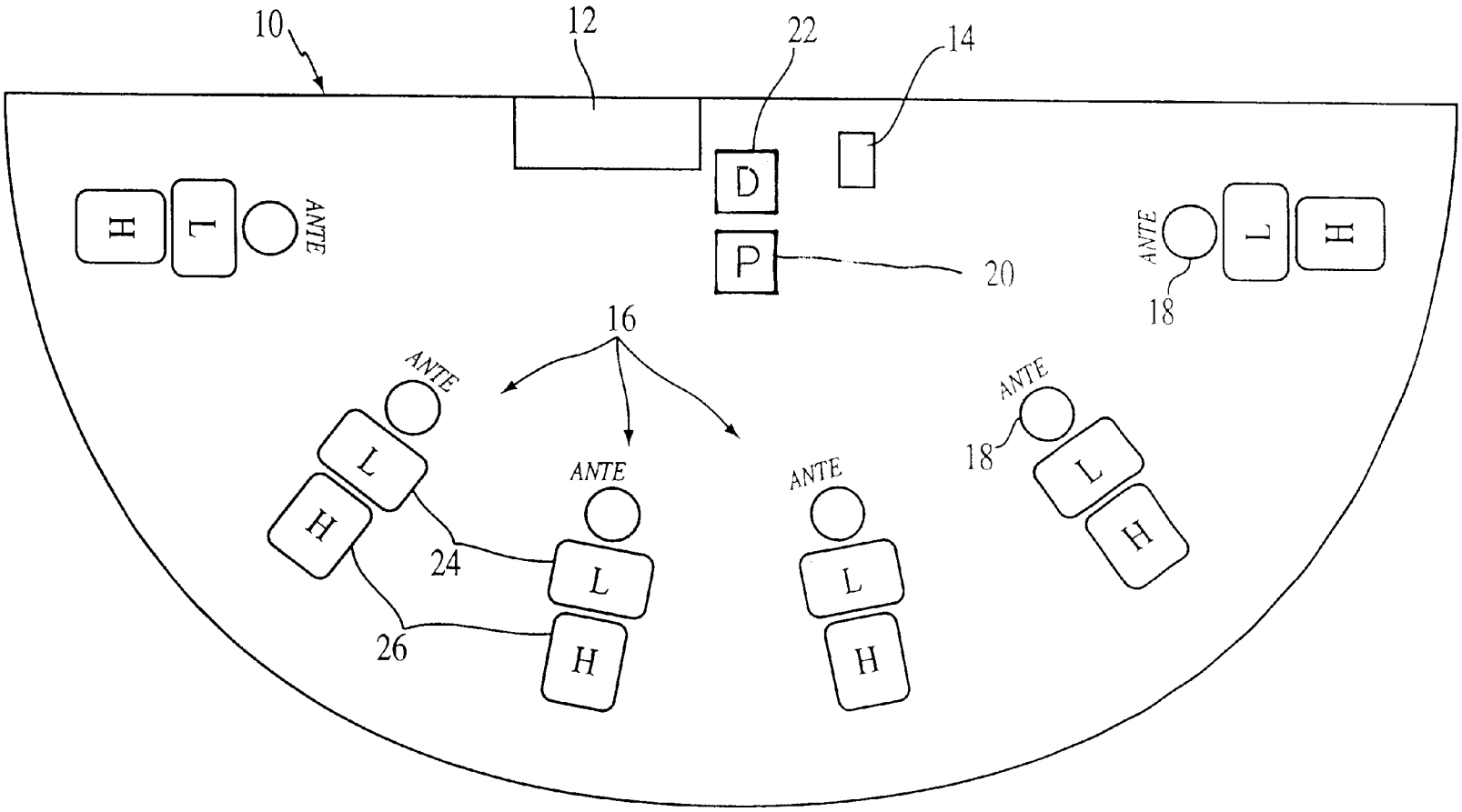
FIG. 1 is a schematic plan view of a gaming table surface for use with the method of the present invention.

With reference now to the drawing in which like numerals represent like elements, the method of play of the modified pai gow poker game will be explained with reference to a table surface 10 depicted in FIG. 1. The method of play of the pai gow game of the present invention is designed for casino type wagering games, in which the wagers are made by each player against a dealer/banker representing the casino using suitable tokens or the like. In this case, the dealer is located along the straight part of table surface 10, and the dealer has a token holder or bank 12 at the dealer's disposal. Of course, other types of banker based games are possible as known in the art, such as where the dealer is not necessarily the banker. As with the usual game of pai gow, the modified pai gow game is also played with a single deck of cards 14 having the usual 52 cards in four suits and values and also including a joker mixed in so that there are 53 cards all together. As in the usual pai gow poker game, the joker is used, at the player's or dealer's discretion, as either an ace or a fill-in card for a straight or a flush in the respective hand of the player or dealer.

Each participating player sits behind a respective player display 16 on which wagers are made and the cards dealt and arranged. Each player display 16 includes an ante wagering area 18 on which the ante bet of each participating player is made. Preferably, the ante bet must be a predetermined minimum, such as $1.

The method of play of the modified pai gow game of the present invention is as follows. Initially, each participating player places an ante bet in area 18. After all bets are placed and the dealer has appropriately shuffled the deck of cards 14, and had the deck cut if desired, seven cards are sequentially dealt to each of the (preferably) six players making an ante bet and the dealer (whose cards at least are face down). After the seven cards are dealt to each player and the dealer, the dealer also deals, from the remaining (preferably four if there are six players) cards of the deck, a player tiebreaker card face down to a player tiebreaker area 20 (labeled "P") and a dealer tiebreaker card face down to a dealer tiebreaker area 22 (labeled "D"). Each player then arranges the seven cards dealt to them as a two-card hand which is placed in a two-card area 24 (labeled "L" to represent the low or two-card hand), and as a five-card hand which is placed in a five-card area 26 (labeled "H" to represent the high or five-card hand). After all players have arranged their hands, the dealer arranges its hand in the same manner in front of bank 12 according to the house rules or the like. Additionally, the dealer at this time turns the tiebreaker cards in areas 20 and 22 face up to reveal those cards to everyone.

Once the dealer's hands are arranged, the dealer immediately pays off in turn each ante bet of the players as follows.

- to the respective player: if both the two-card hand and the five-card hand of the player have a higher poker rank than the respective two-card hand and five-card hand of the dealer,
- to the dealer: if both the two-card hand and the five-card hand of the player have a lower poker rank than the respective two-card hand and five-card hand of the dealer,
- to the respective player: if only one of the two-card hand and five-card hand of the player has a higher poker rank than the respective two-card hand and five-card hand of the dealer, and if the single player tiebreaker card has a higher value than the single dealer tiebreaker card, or
- to the dealer: if only one of the two-card hand and five-card hand of the player has a higher poker rank than the respective two-card hand and five-card hand of the dealer, and if the single player tiebreaker card has a lower value than or value equal to the single dealer tiebreaker card.

It will thus be appreciated that with the present method of play, every ante bet is determined to be a winner or a loser at the end of each round of play. This contrasts with the usual game of pai gow poker where there is a 40% chance that the ante bet will be a push bet, where neither the player or the dealer is considered a winner (as only one of the two-card hand and five-card hand of the player has a higher poker rank than the respective two-card hand and five-card hand of the dealer). It will also be appreciated that with the present method of play the house or dealer has a built-in advantage (as the house wins all ties of the tiebreaker cards) of about 6% of the 40% of the normal push hands. In the usual game of pai gow, the house advantage is the 31% to 29% win advantage afforded by the usual rule that the dealer wins ties of the two-card and five-card hands, as well as the 5% commission on (the 29% of) player wins. These house advantages are thus maintained with the present method of play, so that the overall house advantage is increased by the disclosed method of play with very little time or effort required by the dealer.

The use of the disclosed method of play also increases the speed (and hence profitability) of the pai gow game since the necessity of keeping track of push bets is eliminated.

While the present invention has been described with respect to exemplary embodiments thereof, it will be understood by those of ordinary skill in the art that variations and modifications can be effected within the scope and spirit of the invention.

We claim:

1. A method of playing a pai gow poker game with wagers between a group of respective players and a dealer whose outcome is determined by randomly generated playing cards having various ranks and suits, said method comprising the step of:

wagering an ante bet by each respective player against the dealer;

dealing of seven cards to each player and the dealer, and dealing of a single player tiebreaker card to all players and a single dealer tiebreaker card to the dealer;

arranging of the seven cards dealt to each player by that player into a two-card hand and a five-card hand;

arranging of the seven cards dealt to the dealer by the dealer into a two-card hand and a five-card hand;

paying off of the ante bet of each player to (a) the respective player if both the two-card hand and the five-card hand of the player have a higher poker rank than the respective two-card hand and five-card hand of the dealer, (b) the dealer if both the two-card hand and the five-card hand of the player have a lower poker rank than the respective two-card hand and five-card hand of the dealer, (c) the respective player if only one of the two-card hand and five-card hand of the player has a higher poker rank than the respective two-card hand and five-card hand of the dealer, and if the single player tiebreaker card has a higher value than the single dealer tiebreaker card, or (d) the dealer if only one of the two-card hand and five-card hand of the player has a higher poker rank than the respective two-card hand and five-card hand of the dealer, and if the single player tiebreaker card has a lower value than or value equal to the single dealer tiebreaker card.

2. A method of playing a pai gow poker game as claimed in claim 1:

wherein the playing cards are a standard deck; and wherein said paying off step includes the step of valuing a value of each single tiebreaker card by rank from higher to lower of ace to 2.

3. A method of playing a pai gow poker game as claimed in claim 2:

wherein a joker playing card is included as a playing card in the standard deck; and wherein the joker is usable as an ace or as a fill-in card for straights and flushes in the two-card hands and five-card hands, and is used as an ace for the single tiebreaker card.

* * * * *